US006793102B2

(12) United States Patent
Tan et al.

(10) Patent No.: US 6,793,102 B2
(45) **Date of Patent: *Sep. 21, 2004**

(54) CONTINUOUS-FLOW DRINKING-FLUID DISPENSER

(75) Inventors: Ah Beng Tan, Milpitas, CA (US); Peter H. M. Chang, Milpitas, CA (US)

(73) Assignee: Access Global, Inc., Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/424,957

(22) Filed: Apr. 26, 2003

(65) Prior Publication Data

US 2003/0183649 A1 Oct. 2, 2003

Related U.S. Application Data

(63) Continuation of application No. 09/863,207, filed on May 21, 2001, now Pat. No. 6,588,630.

(51) Int. Cl.[7] ..... B67D 5/06

(52) U.S. Cl. ..... 222/185.1; 222/189.09; 222/62

(58) Field of Search ..... 222/56, 62, 67, 222/69, 189.09, 185.1

(56) References Cited

U.S. PATENT DOCUMENTS

| | | | | |
|---|---|---|---|---|
| 2,772,817 | A | | 12/1956 | Jauch |
| 3,572,553 | A | | 3/1971 | Ogden |
| 4,792,059 | A | | 12/1988 | Kerner et al. |
| 4,805,808 | A | | 2/1989 | Larson |
| 4,881,661 | A | | 11/1989 | Jones |
| 4,923,091 | A | | 5/1990 | Sutera |
| 5,114,042 | A | | 5/1992 | Sutera |
| 5,439,144 | A | | 8/1995 | Holzner |
| 5,567,308 | A | * | 10/1996 | Visser ..... 210/232 |
| 5,611,459 | A | | 3/1997 | Hinch |

* cited by examiner

*Primary Examiner*—Melvin A. Cartagena
(74) *Attorney, Agent, or Firm*—Kam T. Tam

(57) ABSTRACT

A drinking-fluid dispenser includes a bottle disposed on a dispenser base. Mounted inside the bottle is a valve proximally connected to a float by an actuating arm. The valve is positioned above the fluid inside the bottle and is connected to a continuous-flow fluid source. During normal use, the float which buoyantly floats on fluid, closes and opens the valve, respectively, when the fluid rises and falls inside the bottle. There is also a pressure-vent unit having an orifice and is disposed through the bottle above the bottle fluid to maintain atmospheric pressure inside the bottle.

15 Claims, 5 Drawing Sheets

CONTINUOUS-FLOW DRINKING-FLUID DISPENSER

This is a continuation of application having Ser. No. 09/863,207, filed May 21, 2001, now U.S. Pat. No. 6,588, 630.

BACKGROUND OF THE INVENTION

1. Field of the Invention

The present invention relates to fluid storage and dispensing, and more particularly, to storage and dispensing of drinking fluid in a water cooler.

2. Description of the Related Art

Bottled-water coolers have long been used by consumers as preferable sources of drinking water. In a typical bottled-water cooler, a refillable bottle filled with purified water is placed atop a base. The base includes a tank reservoir having at least one spigot.

The bottle and the tank reservoir are in fluid communication with each other. When an user turns on the spigot, water flows out of the tank reservoir which in turn withdraws water from the bottle. When all the water inside the bottle is consumed, the bottle needs to be replaced.

There are various inconveniences associated with bottled-water coolers as mentioned above. First, replacing an empty bottle with a filled bottle is quite a strenuous task. Specifically, it requires a person with considerable physical strength to carry and place a filled bottle atop the base. Mis-positioning the bottle onto the base tank can cause water spillage. Normally, a water distributor is called via telephone in advance. Thereafter, a delivery person delivers a new water bottle and performs the replacement. Thus, replacing the empty bottle is quite inconvenient and time-consuming, not to mention the cost associated with delivery. Alternatively, bottles filled with water can be stored in advance. However, this option requires storage space. Still, there is a need for a person with physical strength to perform the bottle replacement.

There are continuous-flow water coolers available. A typical system is marketed by Topway Global, Inc., Brea, Calif., under the model number POU-425H. Typically, in such a cooler, there is no water bottle visible. Instead, water comes directly from a water supply, such as the water line of a building. That is, the supplied water goes directly to the water tank of the cooler base. Very often, the supplied water passes through a series of filters for purification before entering the tank. The water level inside the tank is sensed electronically. When the water level is above a predetermined level, the sensor inside the tank signals an installed electromechanical valve to shut off the water supply into the tank. On the other hand, when the water level is below the predetermined level, the sensor directs the electromechanical valve to open and allows water to flow into the tank.

In a continuous-flow water cooler, there is no need to constantly replace the depleted water bottles and thus it eliminates all the associated inconveniences. However, a continuous-flow water cooler is more expensive. Furthermore, the electronic sensors with the related circuits are more prone to failure. Since the water level is concealed, when the sensing mechanism fails, spillage can result in a hazardous flooding.

Despite the aforementioned drawbacks, bottled-water coolers have certain consumer appeals. Among other things, the aesthetic display of a bottle of visibly clear water is a key attractive feature. More particularly, a large volume of crystal-clear water inside a transparent bottle conveys the perception of cleanliness and freshness, thereby favorably affecting the user psychologically even before any water is consumed.

To reap the advantages of both the bottled-water and continuous-flow water coolers, hybrid forms of water coolers have been devised. Such a cooler is typically disclosed in U.S. Pat. No. 4,923,091, Sutera, entitled "Self-Filling Bottled-Water Cooler", issued May 8, 1990. In Sutera, a bottle is attached to a water tank base. The bottle is connected to a constant water supply line. Water is admitted to the bottle through a water valve which is submerged under the water level inside the bottle. The valve is linked and actuated by a float which wraps around an elongated tubular air vent. The air vent in turn is centrally positioned inside the bottle in a direction along the height of the bottle. The outlet of the air vent is also below the water level. The float is capable of telescopically moving along the tubular air vent.

When the water level inside the bottle rises, the float moves upwardly until a certain level is reached and shuts off the water valve. On the other hand, when the water level falls, the float follows the receding water level and consequently opens the water valve allowing water to flow into the bottle.

The water cooler of Sutera involves components of considerable large dimensions. The consequential disadvantages are increased costs of manufacturing and assembly. Furthermore, the physically large components moving relative to each other curtail the overall operational reliability.

There is a need to provide a water cooler having the aesthetic advantage of a conventional bottled-water cooler yet without its associated inconveniences.

SUMMARY OF THE INVENTION

It is accordingly the object of the invention to provide a continuous-flow drinking-fluid dispenser with the drinking fluid visible to the user.

It is yet another object of the invention to provide a continuous-flow drinking-fluid dispenser with less moving components and further with components having smaller sizes, thereby improving overall operational reliability and curtailing manufacturing costs.

The drinking-fluid dispenser of the invention includes a bottle having a close end and an open end. In a first embodiment, the open end is attached with a gasket and is sealingly disposed into the opening of a dispenser base via the gasket. Mounted inside the bottle is a valve proximally connected to a float by an actuating arm. The valve is positioned above the fluid inside the bottle and is connected to a continuous-flow fluid source. During normal operation, the float closes and opens the valve, respectively, via buoyantly floating on fluid which rises and falls inside the bottle. There is also a pressure-vent unit with an orifice disposed through the bottle and above the bottle fluid to maintain ambient atmospheric pressure inside the bottle.

In a second embodiment, an adapter is sandwiched between the gasket and the open end of the bottle. The adapter acts as a spacer which allows a regular water bottle to be converted for use as a continuous-flow fluid dispenser in accordance with the invention.

These and other features and advantages of the invention will be apparent to those skilled in the art from the following detailed description, taken together with the accompanying drawings, in which like reference numerals refer to like parts.

DETAILED DESCRIPTION OF THE INVENTION

Figure 1:
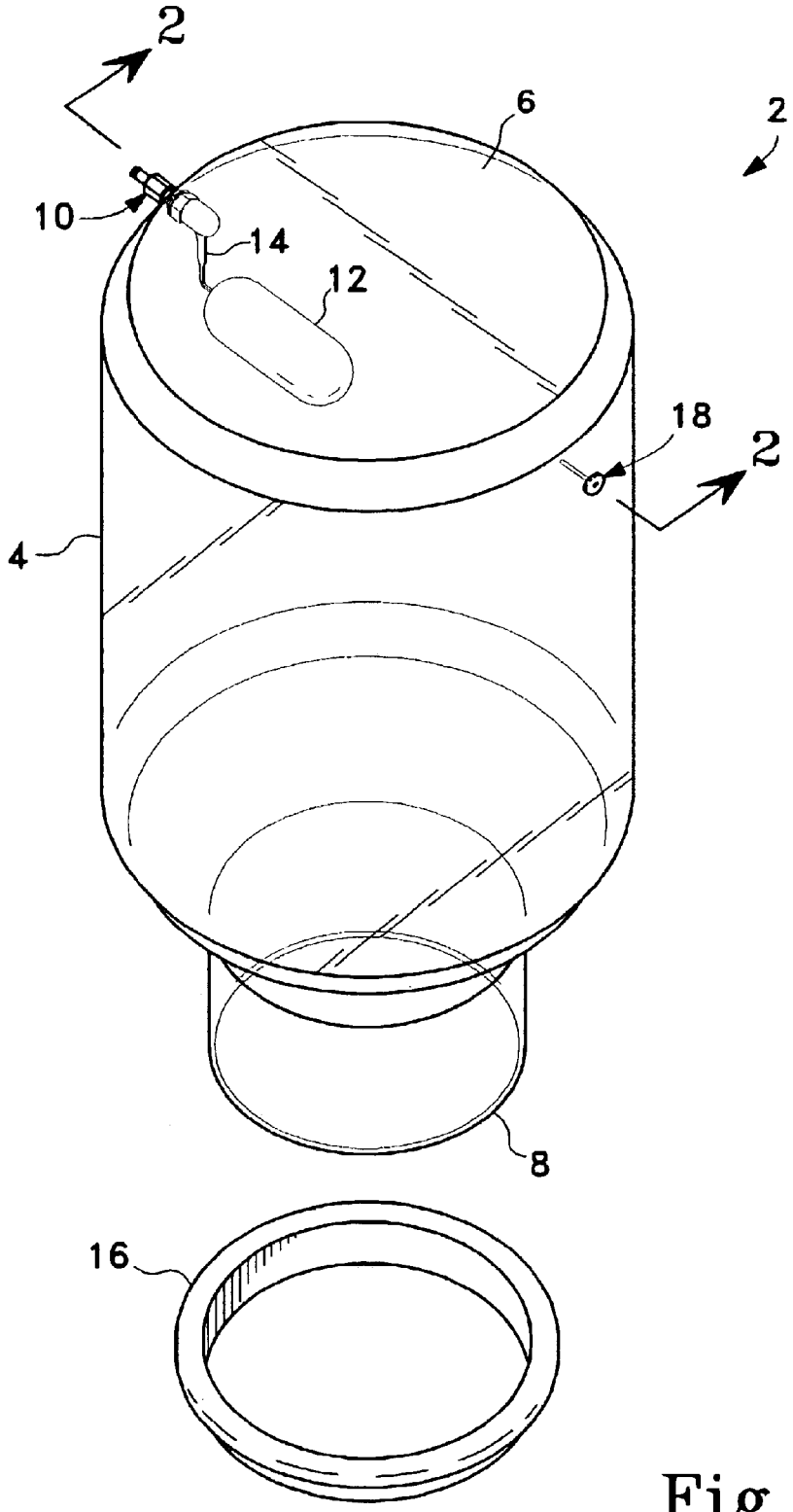
FIG. 1 is an exploded view, shown in perspective, of key components of a first embodiment of the invention.

Reference is now directed to FIG. 1 which shows an exploded view of the key components of a first embodiment of the invention generally signified by the reference numeral 2. The assembly 2 of this embodiment includes a water bottle 4 having an open end 8 and a close end 6. The bottle 4 is preferably made of transparent material such as clear plastic or glass. Disposed inside the bottle 4 is a fluid valve 10 which is actuated by a float 12 via an actuating arm 14. The fluid valve 10 may derive water from a continuous water supply source, such as the main water line (not shown) of a building. Preferably, water from the water supply source passes through a series of filters (not shown) before entering the fluid valve 10. The purification process can be reverse osmosis, or carbon block filtration known in the art.

Figures 2, 3, 3A:
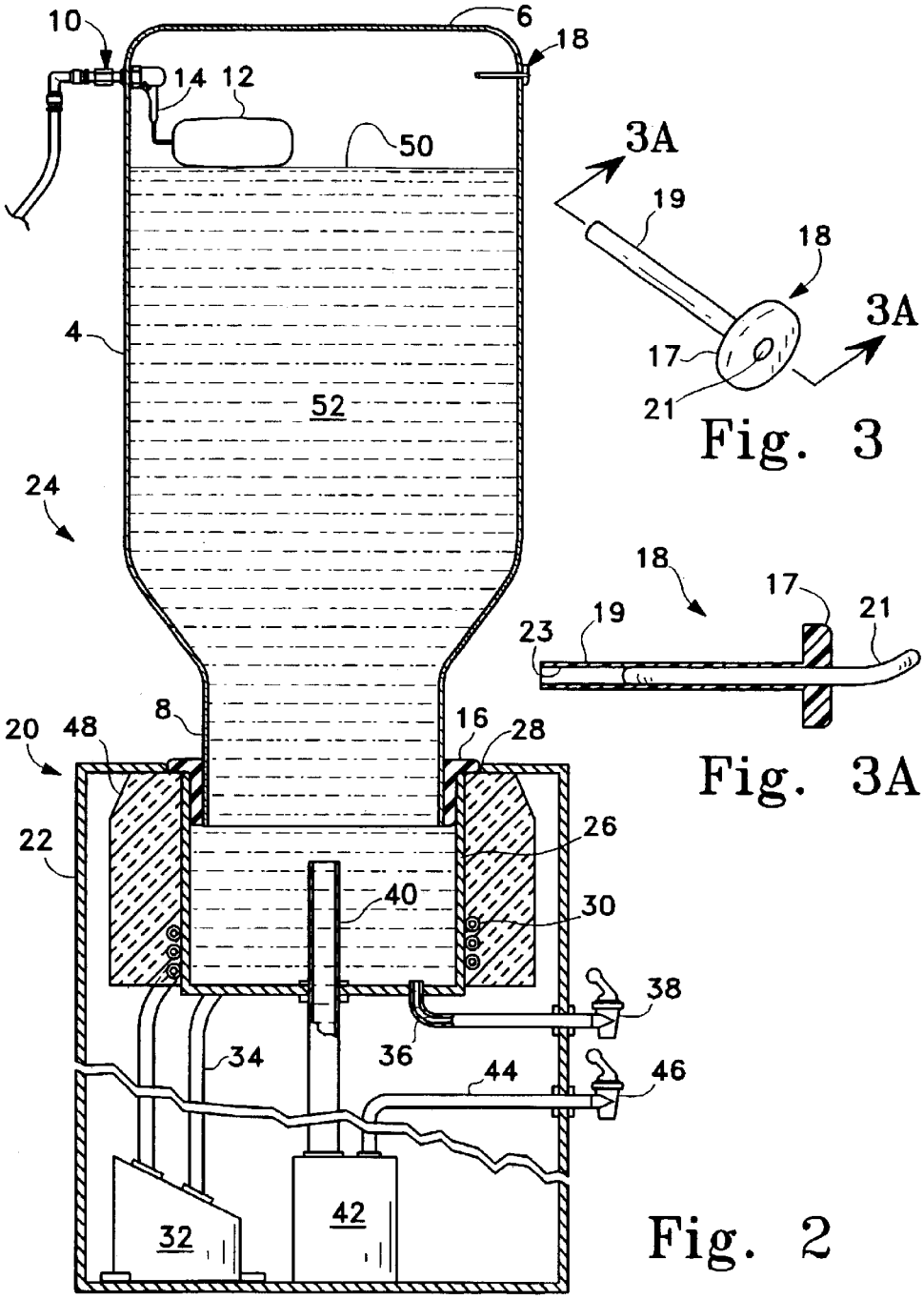
FIG. 2 is a cross-sectional view, taken along the line 2—2 of FIG. 1, of the first embodiment of the invention, when assembled.
FIG. 3 is a perspective view of the pressure vent used in the first embodiment.
FIG. 3A is a cross-sectional view of the pressure vent taken along the line 3A—3A of FIG. 3.

There is a gasket 16 disposed at the open end 8 of the bottle 4. The gasket 16 is preferably made of a resilient material, such as rubber or Teflon®. The gasket 16 can be press-fit or glued onto the open end 8 of the bottle 4. Disposed near the close end 6 of the bottle 4 on the bottle sidewall is a pressure-vent unit 18. In this embodiment, the pressure-vent unit 18 is designed to be insertable through the sidewall of the bottle 4. FIG. 3 is a perspective view of the pressure-vent unit 18. FIG. 3A is a cross-sectional view taken along the line 3A—3A of FIG. 3. In this embodiment, the pressure-vent unit 18 has a flange portion 17 integrally connected to a hollow shaft 19. An orifice 23 is formed longitudinally through the hollow shaft 19. Inserted into the orifice 23 is a filter 21. FIG. 3A shows the filter 21 being partially inserted into the orifice 23 of the hollow shaft 19. The filter 21 is put in place for screening bacteria from entering into the water during use and is preferably made of a porous material such as prolypropylene, cotton or yarn.

FIG. 2 is a cross-sectional view taken along the line 2—2 of FIG. 1. FIG. 2 is shown somewhat schematically with the assembly 2 assembled onto a cooler base 20 which includes a housing 22. The overall dispenser is signified by the reference numeral 24. Positioned inside the housing 22 is a tank reservoir 26 which is preferably made of corrosive-resistant material, such as stainless steel. Atop the tank reservoir 26 is an opening 28 formed in the base housing 22. The bottle 4 of the first embodiment 2 is press-fit into the opening 24 sealingly secured by the gasket 16 as shown in FIG. 2.

The reservoir 26 is wrapped around by a cooling coil 30 which is in fluid communication with a compressor 32. In operation, the compressor 32 compresses and pumps coolant through the hollow coil 30 via the coolant pipes 34. Passing through the bottom of the reservoir 26 is a cool water pipe 36 which is attached to a cool water spigot 38.

Centrally disposed through the bottom of the reservoir 26 is a heater pipe 40 which goes directly to a water heater 42. Exiting out of the water heater 42 is a hot water pipe 44 that is connected to a hot water spigot 46.

Surrounding the tank reservoir 26 is an insulating layer 48 made of thermal insulating material. In this embodiment, the insulting layer 48 is made of styrofoam.

The operation of the water dispensing apparatus 24 is herein described.

Figure 4A:
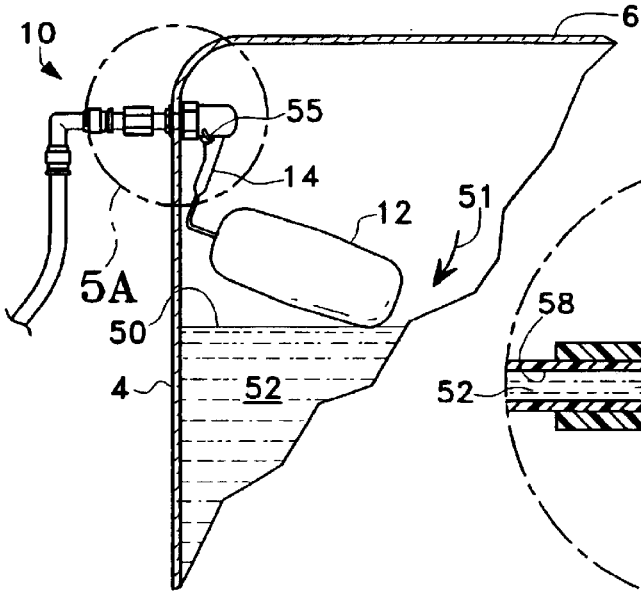
FIG. 4A is a fragmentary view, shown in cross-section, of the float actuating the valve when the fluid level recedes inside the bottle.
Figure 5A:
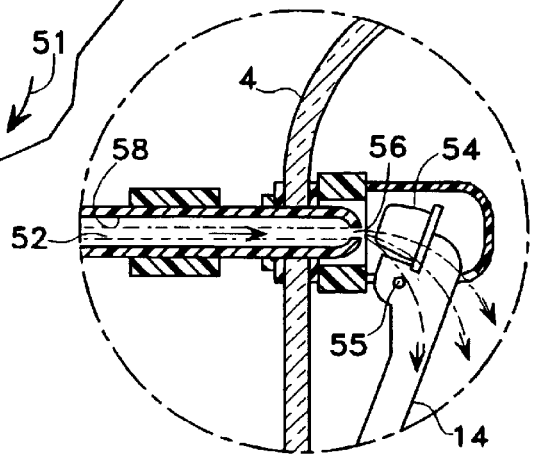
FIG. 5A is an insert view taken within the dashed-line circle 5A of FIG. 4A.
Figure 4B:
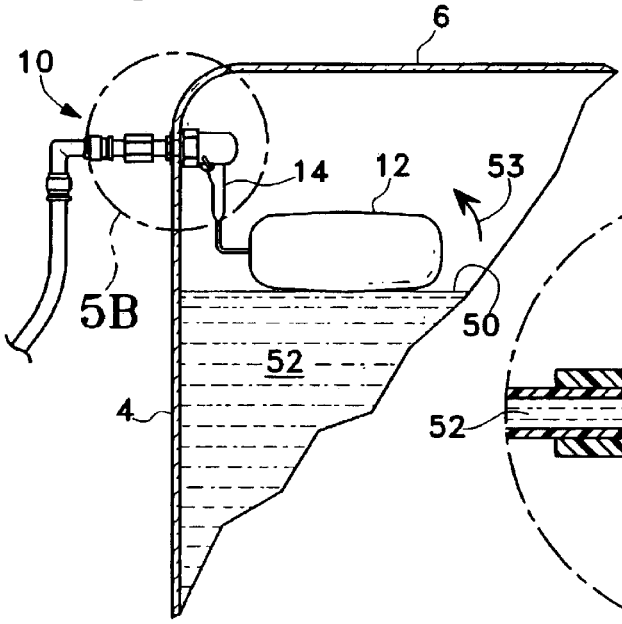
FIG. 4B is a fragmentary view, shown in cross-section, of the float actuating the valve when the fluid level rises inside the bottle.

During normal use, the bottle 4 maintains a predetermined water level 50, as shown in FIG. 2. Reference is now directed to FIGS. 4A and 4B, in conjunction with FIG. 2. Suppose one of the spigots 38 or 46 is turned on. Water 52 is withdrawn from the reservoir 26. Since the reservoir 26 is in fluid communication with the bottle 4, water flows from the bottle 4 to the reservoir 26. As a consequence, the water level 50 falls, as shown in FIG. 4A. Without the buoyancy support of the water 52, the float 12 drops due to its own weight. Consequently, the float 12 rotates the actuating arm 14 in the direction 51 about the arm pivot 55, thereby withdrawing the piston 54 away from the opening 56 of the valve passageway 58, as shown in FIG. 5A. With no blockage of the piston 54, water 52 flows through the opening 56 from the valve passageway 58, and then into the bottle 4. The water 52 flowing into the passageway 58 is derived from a constant water supply source (not shown), such as the water line of a building.

Figure 5B:
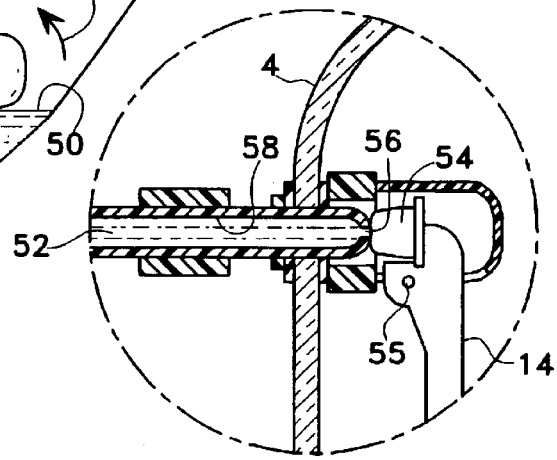
FIG. 5B is an insert view taken within the dashed-line circle 5B of FIG. 4B.

While the water 52 is filling the bottle 4 as described above, the buoyancy force of the rising water 52 pushes the float 12 against its gravitational force and rotates the actuating arm 14 in the other direction 53 about the arm pivot 55, as shown in FIGS. 4B and 5B. As a result, the piston 54 pushes against the opening 56 of the valve passageway 58, thereby preventing any water 52 from escaping from the passageway 58.

It also should be noted that for water to freely flow in and out of the bottle 4, the air inside the bottle 4 beneath the close end 6 but above the water level 50 must maintain the ambient atmospheric pressure. The pressure-vent unit 18 disposed adjacent the close end 6 of the bottle 4 performs this duty. In particular, when the water level 50 recedes, air is sucked into the bottle 4 through the filter 21 disposed in the hollow shaft 19 of the pressure-vent unit 18 (FIGS. 3 and 3A). On the other hand, when the water level 50 inside the bottle 4 rises, air is forced out of the bottle 4 through the filter 21 of the pressure-vent unit 18.

The air-vent unit 18 is designed to be insertable and replaceable. After prolonged use, the air-vent unit 18 may need to be unplugged and replaced with a different unit 18 having a new filter 21. Alternatively, only the filter 21 may be extracted and replaced, without discarding the entire air-vent unit 18.

Albeit with relatively simple design and with not many components, there is an efficient regulatory mechanism built in the valve 10. The piston 54 is made of resilient material, such as rubber or Teflon®. The actuating arm 14 is designed to be pivoted at a high leverage ratio. As such, the piston 54 can exert a strong force against the opening 56 of the valve passageway 58. For the sake of explanation, suppose there is water leakage from the opening 56. The leakage will accumulate water 52 inside the bottle 4, resulting in a higher water level 50 within the bottle 4. Since the water 52 buoyantly pushes upwardly against the float 12 at the water level 50, the float 12 rotates the arm 14 further in the direction 53 (FIG. 4B). As a consequence, the arm 14 presses the piston 54 tighter against the opening 56, thereby sealing the opening 56 from further fluid leakage.

In accordance with the invention, the valve 10 and the pressure-vent unit 18 are positioned above the water level 50. Specifically, the key parts of the embodiment 2 occupy a relatively small volume of space above the water level 50. As is known in the art, the more extensive the components in physical sizes, the less reliable is the final mechanical assembly. Likewise, the more moving parts are installed and involved, the more likely is the final assembly prone to mechanical failure. In accordance with the invention, relatively few moving parts are used. Further, the moving parts are comparatively small in geometry and are disposed above the fluid level 50, wherein the viscosity of the fluid impedes only minimally to the moving parts. Consequently, the parts can respond with reliability and agility.

Figure 6:
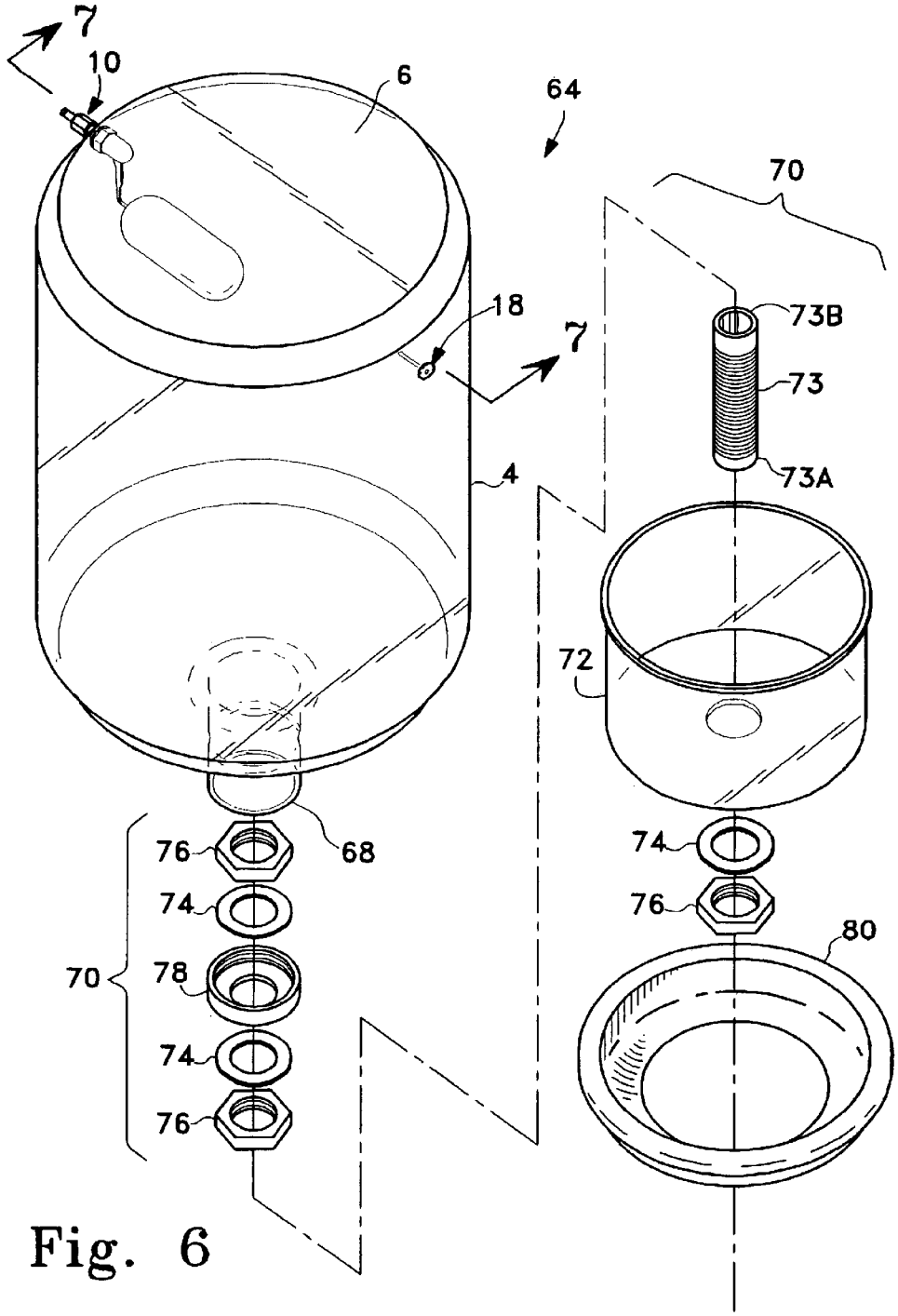
FIG. 6 is an exploded view, shown in perspective, of the key components of a second embodiment of the invention.
Figure 7:
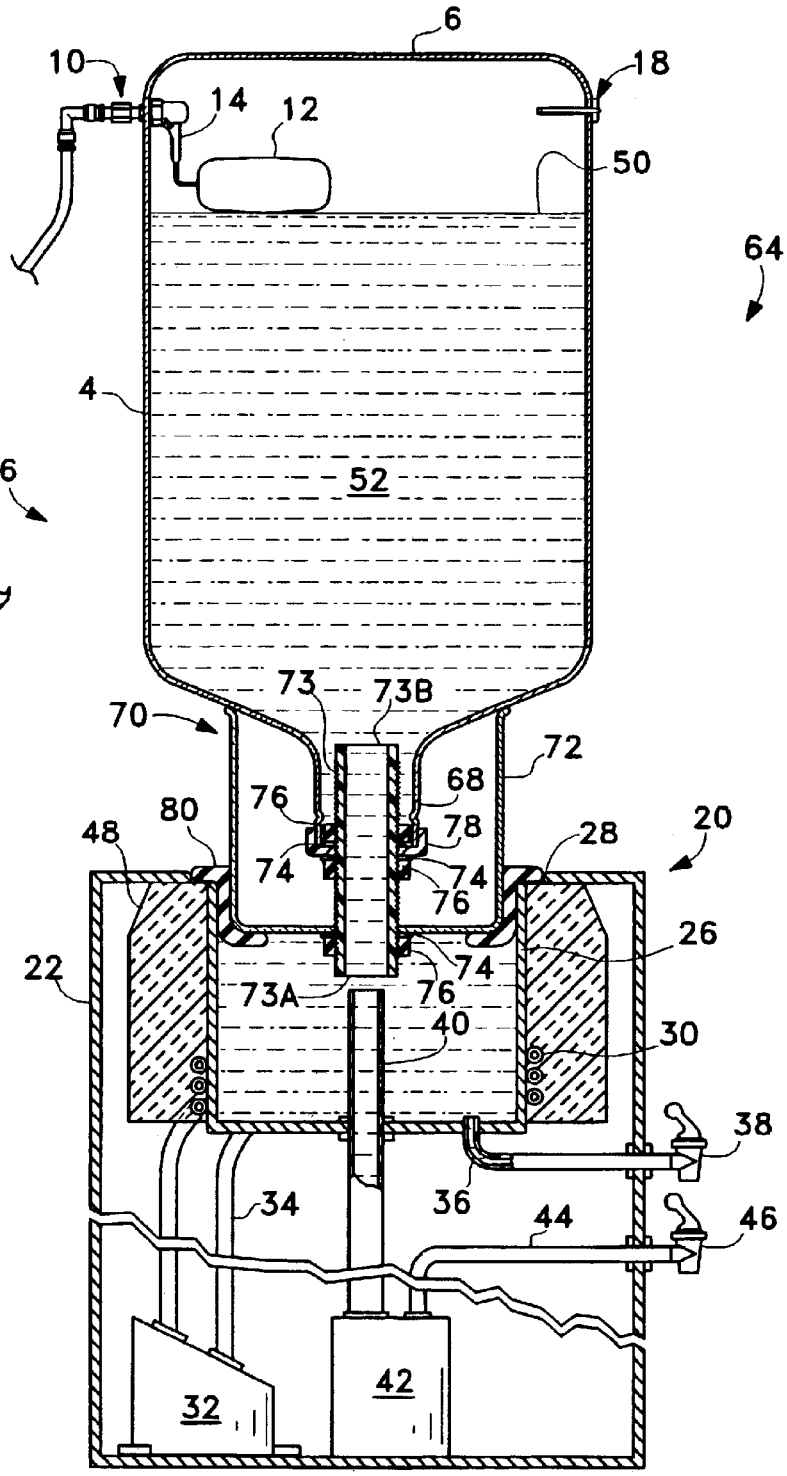
FIG. 7 is a cross-sectional view, taken along the line 7—7 of FIG. 6, of the second embodiment of the invention, when assembled.

FIGS. 6 and 7 show the key components of a second embodiment of the invention generally signified by the reference numeral 64. FIG. 6 is an exploded view exposing the various parts of this embodiment. FIG. 7 is a cross-sectional view taken along the line 7—7 of FIG. 6. FIG. 7 shows the assembly 64 assembled onto the base 20 of the dispenser generally denoted by the reference numeral 66.

As with the first embodiment, the assembly 64 of this embodiment includes a water bottle 4 having an open end 68 and a close end 6. The bottle 4 in this embodiment is made of transparent plastic. In a similar manner as the first embodiment, disposed inside the bottle 4 is a fluid valve 10 which is actuated by a float 12 via an actuating arm 14. Inserted near the close end 6 of the bottle 4 on the bottle sidewall is a pressure-vent unit 18.

Disposed at the open end 68 of the bottle 4 is a plurality of parts assembled together and is generally referred to as an adapter signified by the reference numeral 70. The adapter 70 includes a coupler 72 screwed onto one end 73A of a center tube 73 via a washer 74 and a nut 76. The other end 73B of the center tube 73 is attached to a bottle cap 78, which in turn is threadedly screwed onto the open end 68 of the bottle 4. The cap 78 is sandwiched between two pairs of washers 74 and nuts 76, with one pair on each side of the cap 78, as shown in FIG. 7. The parts for the adapter 70 are preferably made of non-corrosive materials. For example, the coupler 72 can be made of plastic or glass. The nuts 76 and the washers 74 are preferably made of PVC (polyvinyl chloride). There is also a gasket 80 either press-fit or glued onto the coupler 72. In use, the assembly 64 is press-fit into the opening 28 of the cooler base 20.

Again, during normal use, the bottle 4 maintains a predetermined water level 50 inside. During operation, in this embodiment, the water 52 flows from the bottle 4 to the reservoir 26 via the center tube 73. It should be noted that the space between the bottle 4 and the coupler 72 is devoid of water 52. The coupler 72 acts as a spacer accommodating the bottle 4 to the opening 28 of the cooler base 20. The rest of the operation of the cooler 66 is substantially similar to the previous embodiment. For the sake of clarity and conciseness, the operational details of the fluid dispenser 66 are not further repeated.

With the second embodiment, any refillable water bottle commonly used can be converted to a continuous-flow water bottle in accordance with the invention. The key parts of the assembly 64, such as the valve 10, the float 12, the adapter 70 can be made available as a kit allowing the consumers to perform their own conversion.

Finally, other changes are possible within the scope of the invention. For all the embodiments as described, the apparatus is depicted as used for dispensing drinking water. It is conceivable that the inventive apparatus can be used for dispensing other liquids, such as fruit juices, punches or sodas. In addition, the bottle 4 is described as made of transparent material. A wide variety of materials can be chosen. For instance, it is possible to have opaque or translucent bottles installed. It certainly is also feasible to have bottles etched or printed with various design patterns. Furthermore, the bottle can be inserted with multiple air-vent units 18, or an air unit vent with multiple venting holes insertable with multiple filters. It will be understood by those skilled in the art that these and other changes in form and detail may be made therein without departing from the scope and spirit of the invention.

What is claimed is:

1. A drinking-fluid dispenser having a base, said dispenser comprising:

a bottle having an open end and a close end, said bottle being disposed on said base with said open end adjacent said base;

a fluid valve disposed on said bottle adjacent said close end and distanced from said open end;

a float member connected to said fluid valve by an actuating arm; and a pressure-vent member having first and second portions, said second portion includes an orifice formed therethrough with a filter therein, said pressure-vent member being insertably disposed on said bottle adjacent said close end and spaced from said open end with said second portion disposed inside said bottle.

2. The fluid dispenser as set forth in claim 1 wherein said dispenser further including a gasket member attached to said open end, said base having an opening, said bottle being disposed on said base via said gasket member sealingly disposed in said opening of said base.

3. The fluid dispenser as set forth in claim 2 further including an adapter disposed between said open end of said bottle and said gasket member.

4. The fluid dispenser as set forth in claim 3 wherein said adapter includes:

a bottle cap attached to said open end of said bottle, said bottle cap having a first aperture;

a coupler disposed at said open end of said bottle and around said bottle cap, said coupler having a second aperture;

a tube member having first and second ends, said first end being attached to said bottle cap through said first aperture and said second end being attached to said coupler through said second aperture.

5. The fluid dispenser as set forth in claim 1 wherein said bottle is made of transparent material.

6. An assembly for dispensing drinking fluid, comprising:

a bottle having an open end and a close end;

a fluid valve disposed on said bottle adjacent said close end and distanced from said open end;

a float member proximally connected to said fluid valve by an actuating arm, said float member operatively actuating said valve via said arm by buoyantly floating on fluid which rises and falls within said bottle during use; and a pressure-vent member insertably disposed adjacent said close end and distanced from said open end, said pressure-vent member includes a shaft portion attached to a flange portion, said shaft portion includes an orifice formed therethrough, said orifice being sized to receive a filter and being disposed in said bottle.

7. The assembly for dispensing drinking fluid as set forth in claim 6 further including a base, and a gasket member attached to said open end of said bottle, said base having an opening, said bottle being disposed above said base via said gasket member sealingly disposed in said opening of said base.

8. The fluid dispenser as set forth in claim 7 wherein said bottle is made of transparent material.

9. The assembly for dispensing drinking fluid as set forth in claim 6 further including a gasket member, and an adapter disposed between said open end of said bottle and said gasket member.

10. The fluid dispenser as set forth in claim 9 wherein said bottle is made of transparent material.

11. The assembly for dispensing drinking as set forth in claim 10 wherein said adapter includes:

a bottle cap attached to said open end of said bottle, said bottle cap having a first aperture;

a coupler disposed around said bottle cap, said coupler having a second aperture; and a tube member having first and second ends, said first end being attached to said bottle cap through said first aperture and said second end being attached to said coupler through said second aperture.

12. A fluid dispenser having a base with an opening, said dispenser comprising:

a bottle having a close end and an open end;

a gasket attached to said open end of said bottle, said bottle being disposed above said base via said gasket sealingly disposed in said opening of said base;

a valve disposed on said bottle adjacent said close end and distanced from said open end;

a float member connected to said valve by an actuating arm; and a pressure-vent member insertably removably disposed on said bottle, said pressure-vent member includes a shaft portion integrally formed with a flange portion, said shaft portion includes an orifice formed therethrough, said orifice being sized to receive a filter, wherein during operation, said bottle maintains a predetermined fluid level therein, said valve and said float member being disposed above said fluid level, such that when fluid in said bottle reaches said fluid level, said float member buoyantly rises with said fluid thereby moving said actuating arm in one direction allowing said actuating arm to shut off said valve, and such that when fluid in said bottle falls below said fluid level, said float member buoyantly falls with said fluid thereby moving said actuating arm in another direction allowing said actuating arm to open said valve.

13. The fluid dispenser as set forth in claim 12 wherein said bottle is made of transparent material.

14. The fluid dispenser as set forth in claim 12 further including an adapter disposed between said open end of said bottle and said gasket.

15. The fluid dispenser as set forth in claim 14 wherein said adapter includes:

a bottle cap attached to said open end of said bottle, said bottle cap having a first aperture formed therethrough;

a coupler disposed around said bottle cap, said coupler having a second aperture formed therethrough; and a tube member having first and second ends, said first end being attached to said bottle cap through said first aperture and said second end being attached to said coupler through said second aperture.

* * * * *